United States Patent [19]

Kolody

[11] Patent Number: 4,832,231

[45] **Date of Patent: *May 23, 1989**

[54] DUAL BEVERAGE DISPENSER

[76] Inventor: Robert E. Kolody, 415 Old Stone Rd., Munster, Ind. 46321

[ * ] Notice: The portion of the term of this patent subsequent to Jun. 14, 2005, has been disclaimed.

[21] Appl. No.: 152,463

[22] Filed: Feb. 5, 1988

Related U.S. Application Data

[63] Continuation of Ser. No. 897,988, Aug. 19, 1988, Pat. No. 4,750,644.

[51] Int. Cl.[4] ..... B67D 5/60

[52] U.S. Cl. ..... 222/144.5; 222/470; 222/475; 222/514; 222/484

[58] Field of Search ..... 222/144.5, 134, 142.6–142.8, 222/470, 471, 475, 518, 484–486, 129, 488

[56] References Cited

U.S. PATENT DOCUMENTS

| | | | |
|---|---|---|---|
| 756,373 | 4/1904 | Joyce | 222/470 |
| 869,702 | 10/1907 | Friend | 222/144.5 |
| 1,025,653 | 5/1912 | Sims | 222/144.5 |
| 2,047,081 | 7/1936 | Roch et al. | 222/142.8 |
| 2,663,040 | 12/1953 | Leckler | 222/514 |
| 3,146,913 | 9/1964 | Nagi | 222/514 |
| 4,051,984 | 10/1977 | Ho | 222/471 |

*Primary Examiner*—H. Grant Skaggs
*Attorney, Agent, or Firm*—A. A. Saffitz

[57] ABSTRACT

A dispenser of the coffee pot type for dispensing alternatively one or another beverage, such as coffee and decaffeinated coffee, includes a combined handle and lid unit and a two-compartment container. The dispensed liquid is manually selected by pushing on a trigger or stud positioned at the handle-allowing one-hand selection of the liquid to be dispensed from either of two compartments out of a spout in the lid. The selection is made by means of a unitary lid-handle-valve and valve actuator assembly in which all of the elements are in horizontal alignment with the pouring spout. One embodiment uses two valve units in which one valve unit is used for one compartment of the container and the other valve unit is used for another compartment of the container.

4 Claims, 3 Drawing Sheets

DUAL BEVERAGE DISPENSER

This application is a continuation of application Ser. No. 897,988, filed Aug. 19, 1988, now U.S. Pat. No. 4,750,644.

FIELD OF THE INVENTION

The present invention is directed toward a new and improved beverage dispenser and is especially concerned with an improved coffee/decaffeinated coffee dispenser which is easy to make and use.

BACKGROUND OF THE INVENTION

Dual and even three liquid dispensers are known. For example, those shown in U.S. Pat. Nos. 4,355,739 or 3,076,573; British Pat. No. 965,508; and Italian Patent Nos. 459,919, or 515,340. Dual compartment pitchers or containers are shown in French Pat. No. 1,201,115 and U.S. Pat. No. 2.468,661.

Such prior art dispensers are either unable to alternate between one or another beverage at all or else required a two-handed operation to be able to switch between the beverages while holding the dispenser. For example, the Italian Pat. No. 515,340 would require a juggler to switch between its containers single-handedly while carrying it.

While there are dispensers (the covered beer stein, restaurant syrup or cream dispensers) which have covers which are operable by one hand, the covers are employed for cleanliness and to prevent spills, and not to select between two beverages.

SUMMARY OF THE INVENTION

An improved dispenser constructed in accordance with the present invention has two separate compartments for containing, e.g., hot coffee and hot decaffeinated coffee. A lid is secured to the compartments which includes a handle and a pouring spout. Incorporated into the lid is a valve arrangement for opening and closing a pour path between one or the other of the compartments to the spout. Mounted on the handle, for ready manual operation by the same hand as is holding the handle, is a trigger or stud which, when operated, controls the valve arrangement so as to allow dispensing of one or the other of the liquids, i.e., either the hot coffee or the hot decaffeinated.

This allows the dispenser or pot to both carry two hot liquids such as regular coffee and decaffeinated coffee and to be used to dispense either alternatively without the need of the waiter or other user to set down the pot. This can result in quicker service, since it dispenses two coffees without the need to return to get another pot or to pause and shift containers.

The invention, together with other advantages thereof, may best be understood by reference to the following description taken in connection with the accompanying drawings, in the several figures of which, like reference numerals identify like elements.

DETAILED DESCRIPTION

Figure 1:
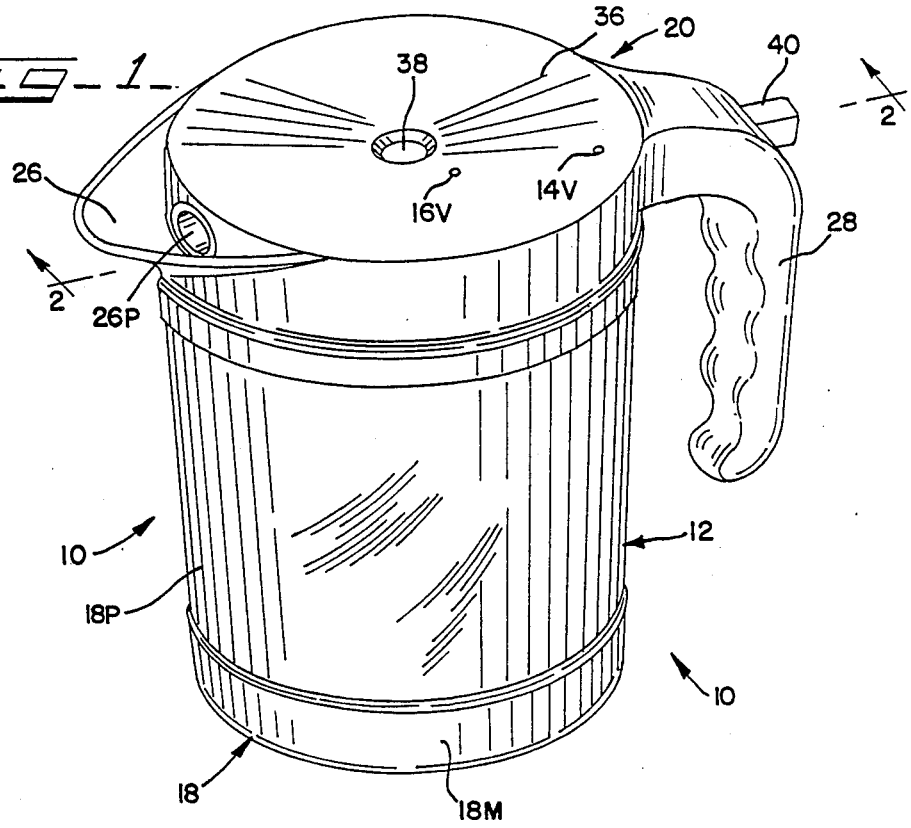
FIG. 1 is a perspective view of a dispenser, construed in accordance with the principles of the present invention.

Referring to FIGS. 1–5 and especially FIG. 1, there is depicted a dispenser constructed in accordance with the principles of the present invention and generally designated by the number 10. The dispenser 10 is a coffee pot which can dispense e.g. either regular or decaf coffee.

Figure 2:
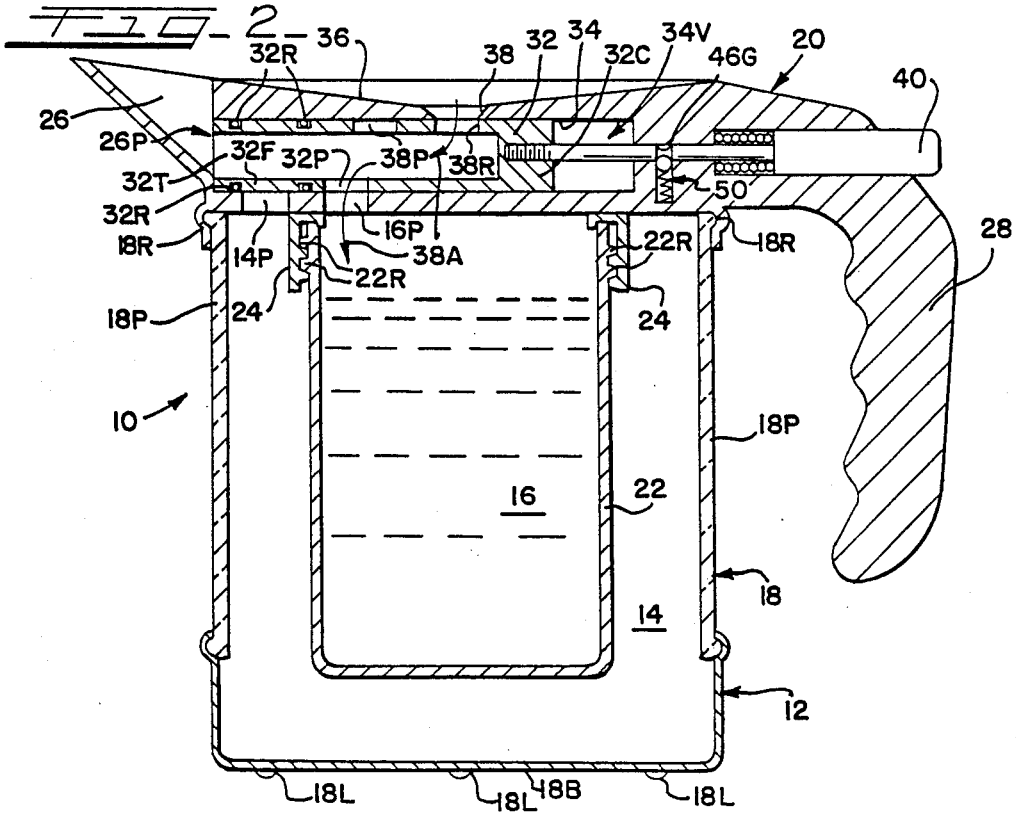
FIG. 2 is a sectional view of the dispenser of FIG. 1 as seen from the plane generally indicated by the line 2—2 when looking in the direction of the arrows.

The coffee pot or dispenser 10, as better shown in FIG. 2, has means 12 defining two compartments, an outer compartment 14 and an inner 16. The compartment defining structure 12 includes an outer pot 18. This is preferably made of a transparent lightweight plastic hollow cylinder 18P and a thin metal base 18M. A suitable plastic material for the cylinder 18P is polysulfone. The base 18M is preferably made of stainless steel and has projections 18L forming legs so as to stand off of a hot plate. The top outer edge of the cylinder 18P has outstanding thread-forming ridges 18R that spiral about its outer surface for aiding in securing it in a well known and conventional manner to a lid and handle unit 20.

The second compartment 16 is defined primarily by a cylindrically shaped container 22 which is closed on its bottom and open at its top and also defines threading 22R at its upper outer surface for securing it into mating female threads on a projection 24 of the lid-handle unit 20.

Figure 3:
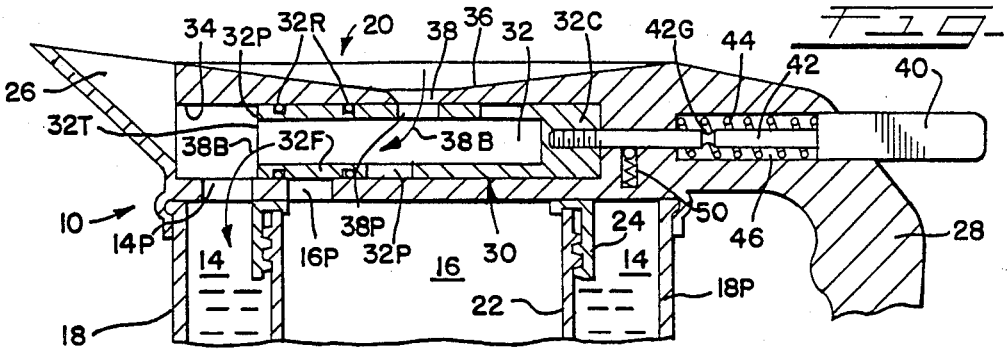
FIG. 3 is a partial sectional view similar to that of FIG. 2 of the dispenser of FIGS. 1–2, with parts shown in a moved position.
Figure 4:
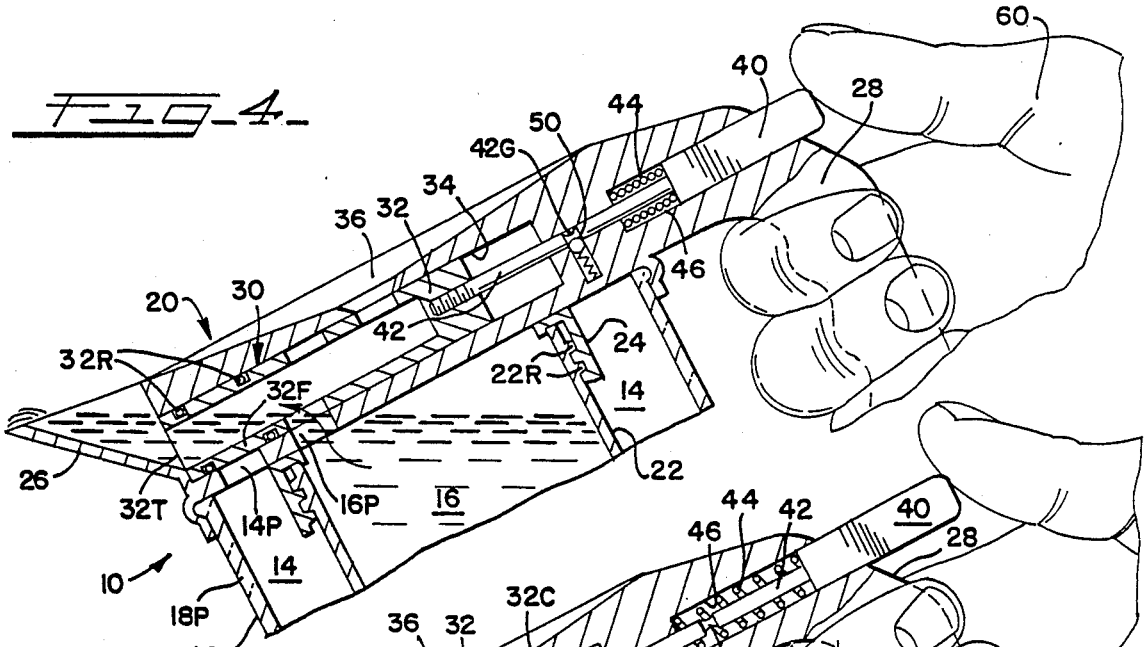
FIG. 4 is a sectional view similar to that of FIG. 3 of the dispenser of FIGS. 1–3 being held by a hand so as to pour or dispense liquid from one container.
Figure 5:
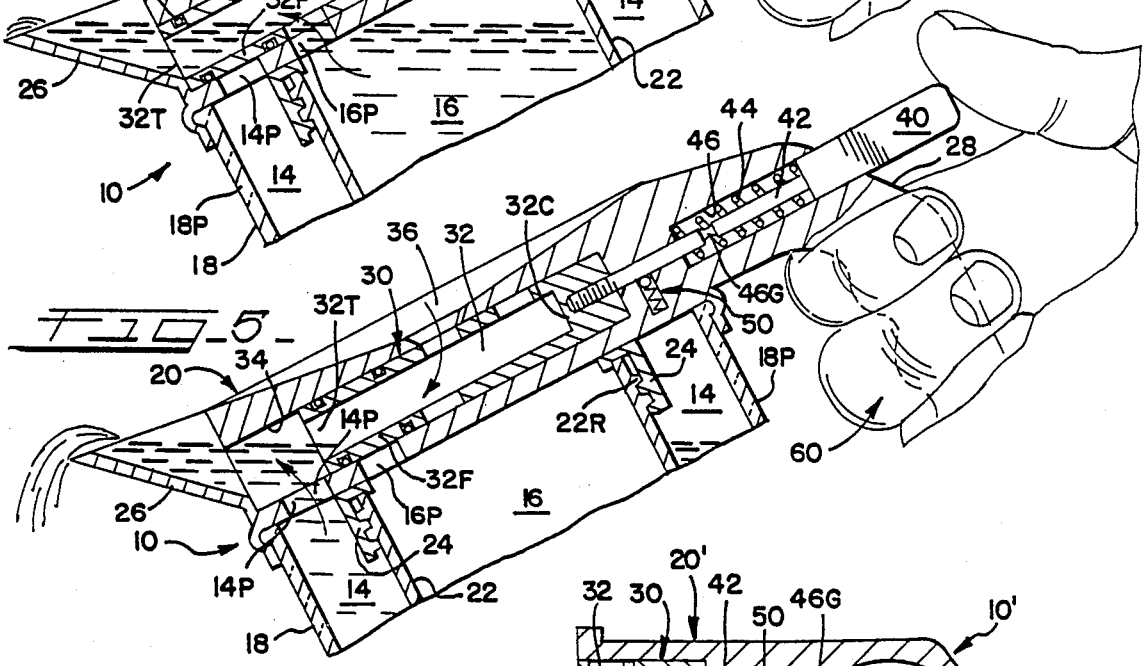
FIG. 5 is a view similar to that of FIG. 4 of the dispenser of FIGS. 1–4 with parts shown in a moved position and to pour liquid from the other container.

The lid-handle unit 20 includes a spout 26 from which liquid can be poured and a handle 28 positioned oppositely from the spout 26. The lid portion of the unit 20 effectively encloses the compartments 14 and 16 except for a port or opening 14P, 16P respectively in each. (Small vent openings 14V, 16v, - FIG. 1— are also provided for venting air— as is conventional.) These ports 14P and 16P are positioned at the nearest location to the spout as is practical so as to allow the respective compartments to be emptied therethrough by pouring action, as will be explained below. Valve means 30 are provided in the unit 20 which valve includes a sliding tubular valve member 32 in a bore 34 defined in the lid of the unit 20. The tube 32 has a single opening or port 32P on its bottom. This port 32P is sized and shaped to correspond with the size and shape of the ports 14P and 16P and is capable of being aligned with the opening 16P as shown in FIGS. 2, 9 and 4 or with the opening 14P as shown in FIGS. 3 and 5.

As is discernable from the opening 26P in FIG. 1, the tube member 32 and the bore 34 are non-circular in shape, preferably oval, as shown, so as to keep the valve unit from rotating.

The valve member 32 is closed at one end 32C and open at its other end 32T. It has a forward section 32F which can cover and close the opening 14P as shown in FIG. 2. Preferably, two "O" rings 32R are provided in grooves encircling the oval outer surface of the member 32 on either side of the area 32F. These provide a seal and ensure that there is no leaking to or from the opening 14P when the member 32 is in its forward position (FIGS. 2 and 4). These rings also serve to seal off the opening 16P when the member 32 is in its rearward position (FIGS. 3 and 5) and its forward section 32F is over and closing that opening 16P.

As shown in FIG. 2, the valve member 32 in the bore 34 which is articulated by means of the push button 40 is in horizontal alignment with the spout 26. The push button 40 and the rod 42 serve as the valve actuator means for valve member 32.

As shown in FIG. 1, the top surface 36 of the unit 20 is a shallow sloping conical shape, like a shallow funnel, which shapes to a central opening 38.

The coffee pot 10 is designed to be used in conventional brewers which dispense brewed coffee (either regular or decaf) in a stream into the top of a pot. The pot 10 can serve to replace a conventional pot in such a brewer.

To this end, the top of the valve member 32 is provided with two openings 38P and 38R which are sized and shaped to conform to the opening 38. When the valve member 32 is in its forward position shown in FIG. 2, the stream of e.g. regular coffee from a brewer may flow as shown by the arrows 38A, through the openings 38R, 32P, and 16P to fill the compartment 16.

When the valve member 32 is in its rearward position, as shown in FIG. 3, the stream of brewed decaffeinated coffee may flow as shown by the arrows 38B through the openings 38, 38P, and 14P to fill the compartment 14.

The sliding valve member 32 is moved by a "trigger" arrangement which includes a push button 40 which drives a rod 42 which is connected to the closed end 32C of the member 32. Pushing on the button 40 also compresses a return spring 44 which includes the rod 42 inside of a cavity 46 formed in the top of the handle 28. A detent 50 comprising a spring biased ball which may seat itself in a groove 42G (as shown in FIGS. 2 and 4) formed in the rod 42. The groove 42G is formed to correspond to the forward position of the slide valve member 32.

The detent 50 serves to releasably latch the valve member 32 and the button 40 in the forward position of Figs. 2 and 4. A slight further depression and then release of the button 40, though, serves to release the rod 42 from the detent and the spring 44 returns the button 40 and with it the rod 42 and valve member 32 to their rearward or "home" position. The spring 44 and the holding strength of the detent 50 should be balanced so as to insure the return to the home position essentially only when released but at a rate of movement that is acceptable. To this end, the "dash pot" effect to air in the volume 34V (FIG. 2) in the base 34 between the closed end 32E of the member 32 and its home position serves to moderate the return of the button 40 to its "home" position (FIG. 3).

As illustrated in FIGS. 4 and 5, the contents of either compartment 16 or 14 may be poured by depressing the button 40 (FIG. 4) or returning it to its home position. Note especially from FIG. 4 that this may be conveniently done by the same hand 60 which grasps the handle and holds the pot 10. As shown in FIG. 4, liquid from compartment 16 flows out of port 16P, through the opening 32P, down the tube of member 32, out opening 32T to the spout 26, and then (hopefully) into a waiting coffee cup. As shown in FIG. 5, alternatively, liquid from compartment 14 may (with the button 40 returned to its home position) flow out of the opening 14P to the spout 26 and thence to a cup.

With only a little practice, a waitress or waiter may easily switch between coffee and decaf (or any other two beverages, such as coffee and tea) without delay and between cups, with not need to put down the pot, switch hand, etc.

Figure 6:
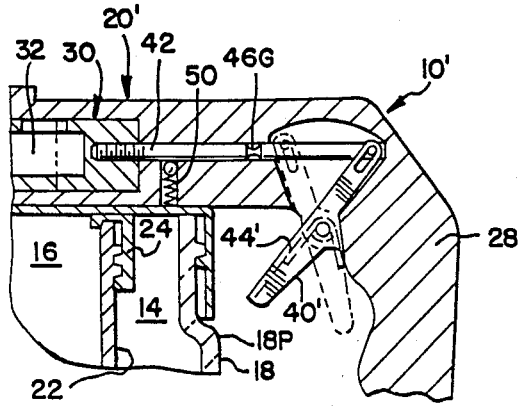
FIG. 6 is a partial sectional view similar to that of FIGS. 2–5 of a modified construction, constituting a second embodiment of the invention, with a moved position of parts shown in dashed outline.

Although a button-like "trigger" means is preferred, a conventional trigger may also be used as may many other trigger arrangements. In FIG. 6 there is depicted a pot 10' which may be identical to that of the pot 10, except for the substitution of a pivoted trigger 40' which is driven by spring 44'.

The pivoted trigger 40' in FIG. 6 provides a pivoted lever construction which in the forward position brings the valve actuator mechanism comprising rod 46g and lever trigger 40' into the rearward position and the movement of the lever 40' into the forward position by the rod is shown in dotted line in FIG. 6. The distinction in the valve actuator between the embodiments in FIG. 6 and FIG. 2 concerns the placement of the return spring 44' in FIG. 6 which lies in the lever and spring 44 in FIGS. 2–4 which lies along the rod portion. The detents 50 in FIGS. 2 and 6 are the same.

Figure 7:
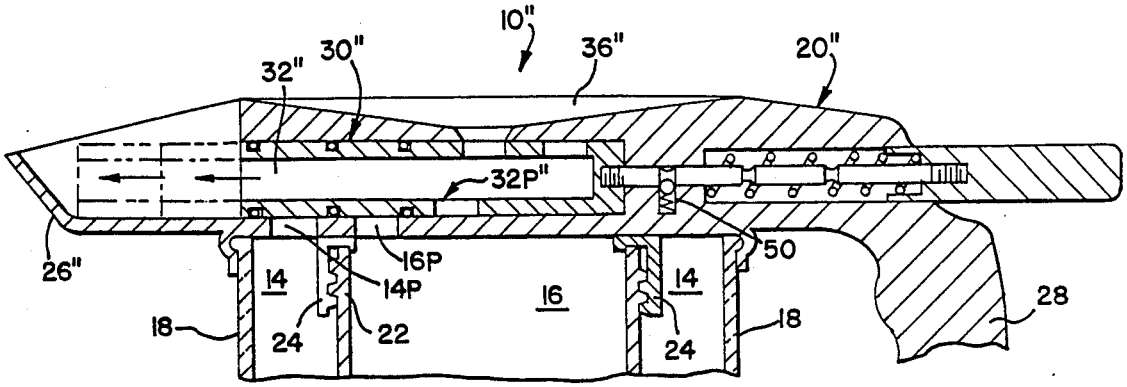
FIG. 7 is a sectional view similar to that of FIGS. 2–4 of another modified construction constituting a third embodiment of the invention.

Under some circumstances (e.g., on airplanes and in railroad car diners) it may be desirable to completely close off both of the main ports to prevent inadvertent pours. The present invention can readily adapt to achieve this end, as shown in the third embodiment 10'' of FIG. 7 and the fourth 10''' embodiment of FIG. 8. Referring to FIG. 7, this embodiment 10'' is similar to that of the first pot 10, except that the valve member 32 is longer and has a home position wherein it blocks off both ports 14P and 16P and two forward operational positions (shown in dashed lines) wherein its opening 32P aligns with one or the other of the openings 16P and 14P.

Figure 8:
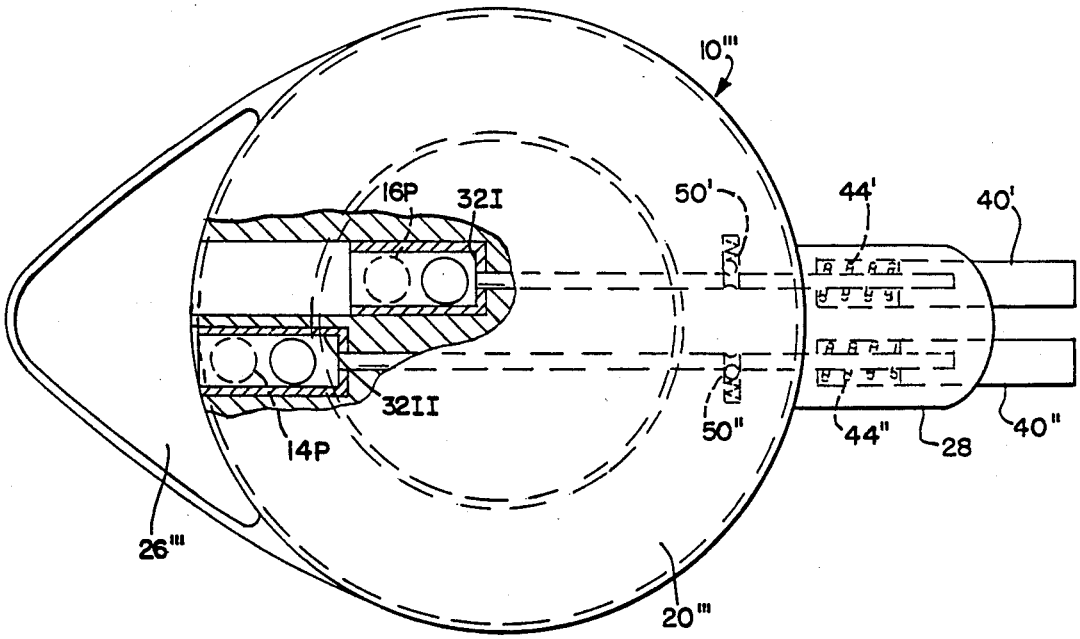
FIG. 8 is a top view, partly broken away and with hidden parts shown in dashed outline, of a fourth embodiment of the invention.

The fourth embodiment 10''' of FIG. 8 achieves the same end by providing two valve units 32I and 32II which are controlled by two push-button trigger mechanisms 40' and 40''. These each have "home" positions which close off the ports 14P and 16P and have detented forward positions which open those ports. Preferably, the buttons of the mechanism are color-coded, (e.g. brown for coffee and orange for decaf) to relate to the beverages dispensed by pushing them.

A prototype of the first embodiment of the invention has been constructed, tested, and shown to work.

It should now be apparent that a new and improved beverage dispenser has been described and depicted, which has many advantages over conventional such units. It can result in a major savings of time for waiter and waitresses —eliminating the requirement to carry two coffee pots or to make two trips to their customers—one with regular and one with decaf. It results in faster and better service to the customers and may decrease the occurrence of spillage. And the inventive pot may be used with existing and conventional brewer units.

The lid and handle units are preferable made of light weight plastic as is the container 22. Again, polysulfone is preferred for the latter. By the use of such materials the weight of the entire dispenser 10 may be approximately equal to that of conventional single beverage glass coffee pots.

Although the invention has been shown encorporated into two-compartment coffee pot, it, in at least its broader aspects, could easily be adapted to be used with a three-compartment dispenser.

One advantage of all of the dispensers described above is that they can all be easily used as is the conventional single beverage container is used. This can be done by simply removing the inner container 22 and detenting the valve member 32 as shown, for example, in FIG. 5.

Note that the compartments 14 and 16 are so arranged that they can be easily cleaned. That is, the smooth inside walls and wide opening mouths of the pots 18 and 22 allow for easy access to the entire inside surface of those containers when they are removed from the lid unit.

It should now be appreciated that a very useful advance in beverage dispensers has been described and depicted. One advantage of this dual beverage dispenser has over the prior systems may not be readily apparent. Often at banquets, a waiter or waitress will carry two different pots, one in each hand. However, since very few people are equally good with pouring with both hands, the risk of a spill is greater with this approach. The present invention, by allowing the waiter or waitress to use their "good" hand to pour, avoids that problem.

Thus while several particular embodiments of the invention have been shown and described, it will be obvious to those skilled in the art that changes and modifications may be made without departing from the invention, and, therefore, the aim in the appended claims is to cover all such changes and modifications as fall within the true spirit and scope of the invention.

I claim:

1. In a dual beverage dispenser having two cylindrical container compartments consisting of inner and outer compartments for separate liquids and a vented lid-handle-valve, valve actuator and spout pouring assembly wherein the handle is located opposite the spout and the handle, valve actuator and valve are in horizontal alignment with the spout, the lid having retaining means and the components each having retaining means to engage each other thereby adapting the lid and compartment to be united together as a dispensing pouring unit, that improvement consisting of:

said valve actuator comprising a push member and a rod;

a spring abutting the valve actuator and lid to return the valve actuator from a forward location for pouring to a rearward position which blocks pouring;

said valve comprising a tubular valve bore within said lid with first and second passageways communicating with said two compartments and said valve being movable by said actuator toward a pouring location to permit pouring liquid selectively through either of said two passageways from the two compartments where liquid from the outer compartment is dispensed through the first passageway and where liquid from the inner compartment is dispensed through the second passageway; and a releasable detent means for detenting the dispensing of liquid from either one of the two compartments, said detent means comprising a groove formed in the rod of said valve actuator and a spring biassed ball mounted in the lid and which is seated in said groove in the detenting position.

2. In a dual beverage dispenser having two cylindrical compartments consisting of inner and outer compartments for separate liquids and a vented lid-handle-valve, valve actuator spout pouring assembly wherein the handle is located opposite the spout an the handle, valve actuator and valve are in horizontal alignment with the spout, the lid having retaining means and the compartments each having retaining means to engage each other thereby adapting the lid and compartments to be united as a dispensing pouring unit, that improvement consisting of:

said valve comprising a tubular valve bore within said lid, first and second passageways communicating with said two compartments respectively through said lid and a valve member movable towards a pouring location adjacent said spout for pouring liquid selectively from either of said two compartments based upon the movement of said valve member from a rearward position where liquid is dispensed from the inner compartment through the first passageway and an outward position for dispensing from the outer compartment through the second passageway;

said valve actuator comprising a pivoted trigger lever and a rod with the lever located at the end of the rod adjacent said handle for moving said valve member to a pouring location;

a spring engaging said trigger lever and said lid for returning said lever to a non pouring location with said valve member pulled back from a pouring location;

said handle of said assembly projecting from said lid and being vertically disposed downwardly to permit the dispenser to be grasped in one hand with a finger of the hand operating said trigger lever whereby the user can hold the dispenser, select the liquid for pouring and manipulate said trigger to effect said selection.

3. A dispenser as claimed in claim 2 wherein said rod is provided with a detent to hold the valve member in a pouring position.

4. In a dual beverage dispenser having two cylindrical compartments consisting of inner and outer compartments for separate liquids and a vented lid-handle-valve, valve actuator spout pouring assembly wherein the handle is located opposite the spout and the handle, valve actuator and valve are in horizontal alignment with the spout, the lid having retaining means and the compartments each having retaining means to engage each other thereby adapting the lid and compartments as a dispensing pouring unit, that improvement consisting of:

said valve and valve actuator each comprising two valve and valve actuator units, one valve and valve actuator unit for said inner compartment and the other valve and valve actuator unit for said outer compartment; each valve and valve actuator unit comprising a valve bore and valve member controlled by a separate valve actuator which is adapted to move the valve member of each valve unit between a rearward location of non pouring and a forward location for pouring;

the first of said two valve units having a first passageway for pouring liquid from said inner compartment;

the second of said two valve units having a second passageway for pouring liquid from said outer compartment;

whereby said valve and valve actuator units permit liquid to be poured from the inner compartment through the first valve unit or liquid to be poured from the outer compartment by the movement of the respective valve actuators of the valve for the inner compartment and the valve for the outer compartment.

* * * * *